US008513902B2

(12) United States Patent
Ohtake et al.

(10) Patent No.: US 8,513,902 B2
(45) Date of Patent: Aug. 20, 2013

(54) POWER SUPPLY UNIT HAVING DIMMER FUNCTION AND LIGHTING UNIT

(75) Inventors: Hirokazu Ohtake, Yokosuka (JP); Hiroshi Terasaka, Yokohama (JP); Mitsuhiko Nishiie, Sunto-Gun (JP); Takuro Hiramatsu, Yokohama (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 407 days.

(21) Appl. No.: 12/557,179

(22) Filed: Sep. 10, 2009

(65) Prior Publication Data

US 2010/0060204 A1 Mar. 11, 2010

(30) Foreign Application Priority Data

Sep. 10, 2008 (JP) ..... 2008-232619
Aug. 21, 2009 (JP) ..... 2009-191891

(51) Int. Cl.
*G05F 1/00* (2006.01)
*H05B 37/02* (2006.01)
*H05B 39/04* (2006.01)
*H05B 41/36* (2006.01)

(52) U.S. Cl.
USPC ..... 315/307; 315/291

(58) Field of Classification Search
USPC ..... 315/307, 291, 294, 185 R, 192, 122, 315/193, 191, 282, 297
See application file for complete search history.

(56) References Cited

U.S. PATENT DOCUMENTS 3,697,774 A 10/1972 Pascente
3,881,137 A 4/1975 Thanawala
4,864,482 A 9/1989 Quazi
5,811,941 A 9/1998 Barton
5,834,924 A 11/1998 Konopka
6,153,980 A 11/2000 Marshall
6,628,093 B2 * 9/2003 Stevens ..... 315/291
6,747,420 B2 * 6/2004 Barth et al. ..... 315/291
6,787,999 B2 9/2004 Stimac
6,969,977 B1 11/2005 Smith (Continued)

FOREIGN PATENT DOCUMENTS

CN 2854998 1/2007
EP 1608206 12/2005

(Continued)

OTHER PUBLICATIONS

English language abstract of JP 2008-210537, published Sep. 11, 2008.
Machine English language translation of JP 2008-210537, published Sep. 11, 2008.
English language abstract of JP-2008-053695 published Mar. 6, 2008.

(Continued)

*Primary Examiner* — Shawki Ismail
*Assistant Examiner* — Dylan White
(74) *Attorney, Agent, or Firm* — DLA Piper LLP (US)

(57) ABSTRACT

In a power supply unit, if a dimmer rate is changed within a range of k1, k2, . . . k7 by a dimmer signal k of a dimmer signal generator, light-emitting diodes are controlled to be lighted by a constant current characteristic in an area where the dimmer rate is small according to a load characteristic corresponding to the dimmer rates k1, k2, . . . k7. As the dimmer rate becomes larger, a tendency of a constant voltage characteristic is gradually strengthened from a constant current characteristic so that the light-emitting diodes are lighted at the larger dimmer rate.

4 Claims, 11 Drawing Sheets

(56) References Cited

U.S. PATENT DOCUMENTS

| | | | | |
|---|---|---|---|---|
| 6,998,792 | B2 | 2/2006 | Takahashi | |
| 7,081,709 | B2 | 7/2006 | Pak | |
| 7,102,340 | B1 | 9/2006 | Ferguson | |
| 7,106,036 | B1 | 9/2006 | Collins | |
| 7,164,235 | B2 | 1/2007 | Ito | |
| 7,202,608 | B2 * | 4/2007 | Robinson et al. | 315/224 |
| 7,262,559 | B2 | 8/2007 | Tripathi | |
| 7,557,520 | B2 * | 7/2009 | Chen et al. | 315/291 |
| 7,564,434 | B2 | 7/2009 | Kim | |
| 7,595,229 | B2 | 9/2009 | Ihme | |
| 7,656,103 | B2 | 2/2010 | Shteynberg | |
| 7,791,326 | B2 | 9/2010 | Dahlman | |
| 7,804,256 | B2 | 9/2010 | Melanson | |
| 7,855,520 | B2 | 12/2010 | Leng | |
| 7,906,917 | B2 | 3/2011 | Tripathi | |
| 7,976,182 | B2 | 7/2011 | Ribarich | |
| 7,999,484 | B2 * | 8/2011 | Jurngwirth et al. | 315/247 |
| 8,013,544 | B2 | 9/2011 | Negrete | |
| 8,018,171 | B1 | 9/2011 | Melanson | |
| 8,018,173 | B2 * | 9/2011 | Shackle et al. | 315/209 R |
| 8,044,608 | B2 * | 10/2011 | Kuo et al. | 315/291 |
| 8,076,867 | B2 | 12/2011 | Kuo | |
| 8,076,920 | B1 | 12/2011 | Melanson | |
| 8,093,826 | B1 * | 1/2012 | Eagar et al. | 315/291 |
| 8,098,021 | B2 | 1/2012 | Wang | |
| 8,102,127 | B2 | 1/2012 | Melanson | |
| 8,134,304 | B2 * | 3/2012 | Hsu et al. | 315/291 |
| 8,212,491 | B2 | 7/2012 | Lost | |
| 8,212,494 | B2 | 7/2012 | Veltman | |
| 2005/0253533 | A1 | 11/2005 | Lys | |
| 2006/0001381 | A1 | 1/2006 | Robinson | |
| 2006/0022916 | A1 | 2/2006 | Aiello | |
| 2006/0071614 | A1 | 4/2006 | Tripathi | |
| 2006/0119181 | A1 | 6/2006 | Namba | |
| 2006/0170370 | A1 | 8/2006 | De Anna | |
| 2006/0192502 | A1 | 8/2006 | Brown | |
| 2006/0238174 | A1 | 10/2006 | Russell | |
| 2006/0261754 | A1 | 11/2006 | Lee | |
| 2007/0030709 | A1 | 2/2007 | Kitagawa | |
| 2007/0069663 | A1 | 3/2007 | Burdalski | |
| 2007/0170873 | A1 * | 7/2007 | Mishima | 315/291 |
| 2007/0182347 | A1 | 8/2007 | Shteynberg et al. | |
| 2007/0183173 | A1 | 8/2007 | Wu | |
| 2007/0188112 | A1 | 8/2007 | Kang et al. | |
| 2007/0216320 | A1 | 9/2007 | Grivas | |
| 2008/0012502 | A1 | 1/2008 | Lys | |
| 2008/0054817 | A1 | 3/2008 | Kao | |
| 2008/0074058 | A1 | 3/2008 | Lee et al. | |
| 2008/0203934 | A1 | 8/2008 | Van Meurs | |
| 2008/0224636 | A1 * | 9/2008 | Melanson | 315/307 |
| 2008/0238387 | A1 | 10/2008 | Schmeller | |
| 2008/0258647 | A1 | 10/2008 | Scianna | |
| 2008/0258698 | A1 | 10/2008 | Kitagawa | |
| 2008/0259655 | A1 | 10/2008 | Wei | |
| 2008/0278092 | A1 | 11/2008 | Lys | |
| 2008/0316781 | A1 | 12/2008 | Liu | |
| 2009/0021470 | A1 | 1/2009 | Lee | |
| 2009/0079363 | A1 | 3/2009 | Ghoman | |
| 2009/0116232 | A1 | 5/2009 | Chang | |
| 2009/0121641 | A1 | 5/2009 | Shih | |
| 2009/0184662 | A1 | 7/2009 | Given | |
| 2009/0184666 | A1 | 7/2009 | Myers | |
| 2009/0295300 | A1 | 12/2009 | King | |
| 2010/0013405 | A1 | 1/2010 | Thompson | |
| 2010/0013409 | A1 | 1/2010 | Quek | |
| 2010/0060204 | A1 | 3/2010 | Ohtake et al. | |
| 2010/0090618 | A1 | 4/2010 | Veltman | |
| 2010/0207536 | A1 | 8/2010 | Burdalski | |
| 2010/0213845 | A1 | 8/2010 | Aiello | |
| 2010/0270935 | A1 | 10/2010 | Otake et al. | |
| 2010/0289426 | A1 | 11/2010 | Takasaka et al. | |
| 2010/0308742 | A1 | 12/2010 | Melanson | |
| 2011/0012523 | A1 | 1/2011 | Pasma | |
| 2011/0043121 | A1 | 2/2011 | Matsuda et al. | |
| 2011/0057564 | A1 | 3/2011 | Otake | |
| 2011/0057576 | A1 | 3/2011 | Otake et al. | |
| 2011/0057577 | A1 | 3/2011 | Otake et al. | |
| 2011/0057578 | A1 | 3/2011 | Otake et al. | |
| 2011/0068706 | A1 | 3/2011 | Otake et al. | |
| 2011/0273095 | A1 | 11/2011 | Myers | |
| 2011/0291587 | A1 | 12/2011 | Melanson | |
| 2012/0139431 | A1 | 6/2012 | Thompson | |

FOREIGN PATENT DOCUMENTS

| | | |
|---|---|---|
| EP | 1689212 | 8/2006 |
| EP | 2257130 | 12/2010 |
| JP | 02-284381 | 11/1990 |
| JP | 09-045481 | 2/1997 |
| JP | 10-0064683 | 6/1998 |
| JP | 11-087072 | 3/1999 |
| JP | 2001-210478 | 8/2001 |
| JP | 2002-231471 | 8/2002 |
| JP | 2003-157986 | 5/2003 |
| JP | 2004-119078 | 4/2004 |
| JP | 2004 265756 | 9/2004 |
| JP | 2004-265756 | 9/2004 |
| JP | 2004-327152 | 11/2004 |
| JP | 2005-011739 | 1/2005 |
| JP | 2005-129512 | 5/2005 |
| JP | 2006-054362 | 2/2006 |
| JP | 2006-108117 | 4/2006 |
| JP | 2006-210835 | 8/2006 |
| JP | 2006-269349 | 10/2006 |
| JP | 2007-6658 | 1/2007 |
| JP | 2007-042758 | 2/2007 |
| JP | 2007-189004 | 7/2007 |
| JP | 2007-234415 | 9/2007 |
| JP | 2007-281424 | 10/2007 |
| JP | 2007-306644 | 11/2007 |
| JP | 2007-538378 | 12/2007 |
| JP | 2008-504654 | 2/2008 |
| JP | 2008-053695 | 3/2008 |
| JP | 2008-210537 | 9/2008 |
| JP | 2008-310963 | 12/2008 |
| JP | 2009-123681 | 6/2009 |
| JP | 2009-218528 | 9/2009 |
| JP | 2009-232625 | 10/2009 |
| WO | WO 99/56504 | 11/1999 |
| WO | WO 03/096761 | 11/2003 |
| WO | WO 2005/115058 | 12/2005 |
| WO | WO 2006/120629 | 11/2006 |
| WO | WO 2008/029108 | 3/2008 |
| WO | WO 2009/014418 | 1/2009 |
| WO | WO 2009/055821 | 4/2009 |
| WO | WO 2009/119617 | 10/2009 |

OTHER PUBLICATIONS

Machine English language translation of JP-2008-053695 published Mar. 6, 2008.

English language abstract of JP-2007-538378 published Dec. 27, 2007.

Machine English language translation of JP-2007-538378 published Dec. 27, 2007.

English language abstract of JP 2005-11739 published Jan. 13, 2005.

Machine English language translation of JP 2005-11739 published Jan. 13, 2005.

English language abstract of JP 11-087072 published Mar. 30, 1999.

Machine English language translation of JP 11-087072 published Mar. 30, 1999.

English Language Abstract of JP 2009-218528 Published Sep. 24, 2009.

English Language Translation of JP 2009-218528 Published Sep. 24, 2009.

English Language Abstract of JP 2004-119078 Published Apr. 15, 2004.

English Language Translation of JP 2004-119078 Published Apr. 15, 2004.

English Language Abstract of JP 2007-6658 Published Jan. 11, 2007.

English Language Translation of JP 2007-6658 Published Jan. 11, 2007.

English Language Abstract of JP 2008-310963 Published Dec. 25, 2008.

English Language Translation of JP 2008-310963 Published Dec. 25, 2008.
International Search Report issued in PCT/JP2009/055871 on Jun. 9, 2009.
English Language Abstract of JP 2002-231471 Published Aug. 15, 2002.
English Language Translation of JP 2002-231471 Published Aug. 15, 2002.
English Language Abstract of JP 2004-327152 Published Nov. 18, 2004.
English Language Translation of JP 2004-327152 Published Nov. 18, 2004.
English Language Abstract of JP 2005-129512 Published May 19, 2005.
English Language Translation of JP 2005-129512 Published May 19, 2005.
English Language Abstract of JP 2007-234415 Published Sep. 13, 2007.
English Language Translation of JP 2007-234415 Published Sep. 13, 2007.
English Language Abstract of JP 2001-210478 Published Aug. 3, 2001.
English Language Translation of JP 2001-210478 Published Aug. 3, 2001.
English Language Abstract of JP 2006-269349 Published Oct. 5, 2006.
English Language Translation of JP 2006-269349 Published Oct. 5, 2006.
International Search Report issued in PCT/JP2009/055873 on Jun. 9, 2009.
Japanese Office Action issued in JP 2008-076837 on Jul. 6, 2010.
English Translation of Japanese Office Action issued in JP 2008-076837 on Jul. 6, 2010.
English Language Abstract of JP 2006-108117 published Apr. 20, 2006.
Machine Translation of JP 2006-108117 published Apr. 20, 2006.
English Language Abstract of JP 2008-281424 published Nov. 20, 2008.
Machine Translation of JP 2008-281424 published Nov. 20, 2008.
Japanese Office Action issued in JP 2008-076835 on Aug. 24, 2010.
English Translation of Japanese Office Action issued in JP 2008-076835 on Aug. 24, 2010.
Japanese Office Action issued in JP 2008-076837 on Nov. 24, 2010.
English Translation of Japanese Office Action issued in JP 2008-076837 on Nov. 24, 2010.
English Abstract of JP 2009-232625 published Oct. 8, 2009.
English Translation of JP 2009-232625 published Oct. 8, 2009.
English Abstract of JP 2007-306644 published Nov. 22, 2007.
English Translation of JP 2007-306644 published Nov. 22, 2007.
Extended European Search Report issued in European Appl 09011497.6 on Jan. 28, 2010.
English Abstract of Japanese Publication 2004-265756 published Sep. 24, 2004.
English Machine Translation of Japanese Publication 2004-265756 published Sep. 24, 2004.
Extended European Search Report issued in EP 10162031.8 on Jul. 21, 2011.
U.S. Appl. No. 12/557,179.
Extended European Search Report issued in EP 10177426.3 on May 4, 2011.
Chinese Office Action mailed Jul. 21, 2011 in CN 201010178232.8.
English Language Translation of Chinese Office Action mailed Jul. 21, 2011 in CN 201010178232.8.
International Preliminary Report on Patentability and Written Opinion mailed Nov. 81, 2010 in PCT/JP2009/055871.
International Preliminary Report on Patentability and Written Opinion mailed Nov. 81, 2010 in PCT/JP2009/055873.
Japanese Office Action issued in JP 2010-213133 on Jun. 14, 2012.
English Language Translation of Japanese Office Action issued in JP 2010-213133 on Jun. 14, 2012.
English Language Abstract of JP 2009-189004 published Jul. 26, 2007.
English Language Translation of JP 2009-189004 published Jul. 26, 2007.
English Language Abstract of JP 2006-210835 published Aug. 10, 2006.
English Language Translation of JP 2006-210835 published Aug. 10, 2006.
English Language Abstract of JP 2009-123681 published Jun. 4, 20120.
Engltsh Language Translation of JP 2009-123681 published Jun. 4, 20120.
Japanese Office Acton issued in JP 2010-235474 on Apr. 19, 2012.
English Language Translation of Japanese Office Action issued in JP 2010-235474 on Apr. 19, 2012.
English Language Abstract of JP 2008-504654 published Feb. 14, 2008.
English Language Translation of JP 2008-504654 published Feb. 14, 2008.
Japanese Office Action issued in JP 2010-235473 mailed Jul. 19, 2012.
English Language Translation of Japanese Office Action issued in JP 2010-235473 mailed Jul. 19, 2012.
English Language Abstract of JP 2007-042758 published Feb. 15, 2007.
English Language Translation of JP 2007-042758 published Feb. 15, 2007.
English language abstract of JP-2003-157986, May 30, 2003.
Machine English language translation of JP-2003-157986, Sep. 9, 2009.
Japanese Office Action issued in JP 2010-235474 on Apr. 19, 2012.
Supplementary European Search Report issued in EP 09725738 on Aug. 17, 2012.
Notice for Corresponding Japanese Patent Application No. 2010-196338 mailed Jul. 12, 2012.
English Translation of Notice for Corresponding Japanese Patent Application No. 2010-196338 mailed Jul. 12, 2012.
Japanese Office Action issued in JP2010-196338 mailed Jul. 26, 2012.
English Language Translation of Japanese Office Action issued in JP2010-196338 mailed Jul. 26, 2012.
European Office Action issued in EP 09725489 mailed Aug. 17, 2012.
English Language Abstract of JP 2006-054362 published Feb. 23, 2006.
English Language Translation of JP 2006-054362 published Feb. 23, 2006.
English Language Abstract of JP 2-284381 published Nov. 21, 1990.
English Language Abstract of JP 09-045481 published Feb. 14, 1997.
English Language Translation of JP 09-045481 published Feb. 14, 1997.
English Language Abstract of JP 10-064683 published Jun. 3, 1998.
English Language Translation of JP 10-064683 published Jun. 3, 1998.
U.S. Appl. No. 13/687,973, filed Nov. 28, 2012.
U.S. Appl. No. 12/873,744.
U.S. Appl. No. 13/687,973.
Extended European Search Report issued in EP 10173250.1-1239 on Oct. 19, 2012.
European Office Action issued in EP10175037 on Sep. 7, 2012.
Extended European Search Report issued in EP 1015037 Dec. 15, 2011.
English Language Translation of CN 2854998 published Jan. 3, 2007.
U.S. Appl. No. 12/764,995.
U.S. Appl. No. 12/873,759.
U.S. Appl. No. 12/873,348.
U.S. Appl. No. 12/885,053.
U.S. Appl. No. 12/860,528.
U.S. Appl. No. 12/777,303.
U.S. Appl. No. 12/874,282.

* cited by examiner

POWER SUPPLY UNIT HAVING DIMMER FUNCTION AND LIGHTING UNIT

CROSS-REFERENCE TO RELATED APPLICATIONS

This application is based upon and claims the benefit of priority from prior Japanese Patent Applications No. 2008-232619, filed Sep. 10, 2008; and No. 2009-191891, filed Aug. 21, 2009, the entire contents of both of which are incorporated herein by reference.

BACKGROUND OF THE INVENTION

1. Field of the Invention

The present invention relates to a power supply unit having a dimmer function for driving a semiconductor light emitting module so as to light the semiconductor light emitting module at suitably dimmed brightness, and a lighting unit having this power supply unit.

2. Description of the Related Art

Recently, from a viewpoint of energy saving, semiconductor light emitting modules such as light-emitting diodes are used as light sources for lighting units, and DC power supply units into which switching elements are incorporated are developed as power supplies which drive the semiconductor light emitting modules such as the light-emitting diodes. As these power supply units, it is known that they have a dimmer function for adjusting brightness of the light-emitting diodes according to a dimmer signal given from the outside.

Conventionally, the power supply unit having such a dimmer function is disclosed in, for example, JP-A 2003-157986 (KOKAI). The power supply unit disclosed in this publication has a voltage dimmer circuit which controls an applied voltage to light-emitting diodes, and a duty dimmer circuit which switching-controls an applied voltage to the light-emitting diodes. The voltage dimmer circuit and the duty dimmer circuit are changed over to be controlled according to a dimmer control signal.

In the power supply unit disclosed in JP-A 2003-157986 (KOKAI), a DC voltage given to the light-emitting diodes is adjusted according to a pulse width of the dimmer signal, and an applied voltage to the light-emitting diodes is switched so that the light-emitting diodes are controlled to be dimmed. Therefore, output light from the light-emitting diodes has a problem that flicker easily occurs. In addition to a current limiting function for controlling an output current according to the pulse width of the dimmer signal, a switching element which is in series or in parallel with the light-emitting diodes is necessary, and thus the number of parts increases and circuit efficiency is deteriorated. Since the pulse width is controlled, when a switching frequency for this control is in an audible area, a noise might be generated.

On the other hand, since the light-emitting diodes have an approximately constant voltage characteristic, a part or a device having the current limiting element is necessary for stable lighting. In order to control an electric power in a power supply unit using a switching element, current control is generally used. In the current control, an element temperature of the light-emitting diodes is determined by a value of an electric current flowing in the light-emitting diodes, and the element temperature influences an element life. Therefore, in the current control, the flowing electric current is the important control element due to design of the lighting unit.

The dimming of the light-emitting diodes can be realized comparatively more easily than a discharge lamp lighting unit. The light-emitting diodes as a load have stable electric characteristics, and fluctuation in the brightness of the light-emitting diodes due to an external factor such as temperature is small. For this reason, the dimming of the light-emitting diodes can be easily realized. In the application of deep dimmer control, namely, brightness control where a brightness control rate or a dimmer rate is set large and thus brightness of the light-emitting diodes is greatly reduced, the constant current control is adopted to the light-emitting diodes. In this constant current control system, the light-emitting diodes can be lighted stably in a control area where lighting current is high for full-emission lighting. In this system, however, the lighting current supplied to the light-emitting diodes is lowered in the deep dimmer control area, and a current detecting signal becomes minute according to the lowering of the lighting current, and a reference current for controlling the lighting current is a minute signal. Therefore, in a constant current control circuit, accuracy of a detecting circuit or a comparator requires high performance, and the control circuit is easily influenced by a noise, so that a stable operation becomes difficult. It is thus considered that a signal voltage for control is increased. However, the current detecting signal is generally detected by a resistor inserted in series into the light-emitting diodes, and resistance of the resistor should be increased in order to increase the detecting signal. As a result, in the control area where the electric current flowing in the light-emitting diodes is high, the electric power is greatly consumed by the detection resistor, or heat is generated from the detection resistor, and a countermeasure against this heat inhibits developments of products.

As a control system which solves these problems, a constant voltage control system which constantly controls an output voltage is also proposed. A voltage for turning on the light-emitting diodes is higher than that for a general. silicon diode. For example in a GaN type diode represented by blue one, an electric current starts to flow at about 2.5 V, and about 3.5 to 4.5 V in the full-emission lighting, and the brightness of the light-emitting diodes can be controlled comparatively stably without being influenced by the performance of the light-emitting diodes or a noise generated on the light-emitting diodes even in the deep dimmer control. However, a forward voltage of the light-emitting diodes has a negative temperature characteristic, and the forward voltage is decreased due to self heat generation at the time of applying an electric current to the light-emitting diodes, and the electric current increases. As a result, heat generation becomes large, and thus thermo-runaway might occur. The forward voltage of the light-emitting diodes greatly varies, and even if an output from the lighting unit is adjusted, output currents vary due to a individual difference of respective light-emitting diodes.

The above-mentioned problem arises not only in the semiconductor light emitting modules such as the light-emitting diodes but also in the power supply units which light a light source such as an organic EL light source or an inorganic EL light source developed in recent years, and this problem still remains unsolved.

The power supply unit and the lighting unit having the power supply unit which can realize the stable dimmer control are already proposed as a prior application in International Application No. PCT/JP2009/055871 filed on Mar. 24, 2009 by the same assignee. In the power supply unit of the International Application, first and second reference signals, which change according to a dimmer rate of a dimmer signal, namely, a dimmer level, are prepared. In the almost full-emission lighting control area where the dimmer rate is small, the first reference signal is selected, and light-emitting diodes are controlled with constant current with reference to the first signal. In a lighting control area where the dimmer rate is large and the brightness is reduced, the second reference signal is selected, and the light-emitting diodes are controlled with constant voltage with reference to the second reference signal. Since the first and second reference signals are selected so that the light emission from the light-emitting diodes is controlled, the stable dimmer control can be realized.

BRIEF SUMMARY OF THE INVENTION

An object of the present invention is to provide a power supply unit and a lighting unit which can realize stable dimmer control.

According to a first aspect of the present invention, there is provided a power supply unit comprising:

a semiconductor light emitting module;

a power supply part which lights the semiconductor light emitting module in accordance with one of load characteristics, wherein the load characteristics have inclination lines extending from a base point, whose inclinations are changed depending on dimmer rates, respectively;

a voltage detecting part which detects a load voltage applied to the semiconductor light emitting module to generate a voltage detection signal;

a current detecting part which detects an electric current supplied to the semiconductor light emitting module to generate a current detection signal; and a control part which controls the power supply part depending on the voltage detection signal, the current detection signal, and a dimmer signal having one of the dimmer rates, to adjust a power supplied to the semiconductor light emitting module from the power supply part and the power is set depending on one of the inclination lines of the load characteristic which is set in accordance with the dimmer rate.

According to a second aspect of the present invention, there is provided the power supply unit according to the first aspect, wherein the inclination lines of the load characteristics are radially extended from the base point DIa (constant value) depending on the dimmer rates, and each of the load characteristics is substantially expressed by a function formula of {I+k(V)=Dia}, where I represents the electric current flowing in the semiconductor light emitting module, V represents the load voltage applied to the semiconductor light emitting module, and k represents one of the dimmer rates.

According to a third aspect of the present invention, there is provided the power supply unit according to the first or second aspect, wherein the control part controls the power supply part depending on a constant current characteristic, a constant voltage characteristic, and a combination of a constant current characteristic and a constant voltage characteristic, if the dimmer rate is smaller than a predetermined rate, the current detection signal is weighted and thus a tendency of a constant current characteristic is strengthened, and if the dimmer rate is not smaller than the predetermined rate, the voltage detection signal is weighted and thus a tendency of a constant voltage characteristic is strengthened.

According to a fourth aspect of the present invention, there is provided a lighting unit comprising:

the power supply unit according to any one of the first to third aspects; and a unit main body having the power supply unit.

DETAILED DESCRIPTION OF THE INVENTION

A power supply unit and a lighting unit according to embodiments of the present invention will be described below with reference to the drawings.

First, an operation principle of a dimmer function for dimming light-emitting diodes in the power supply unit of the present invention will be simply described.

Figure 1:
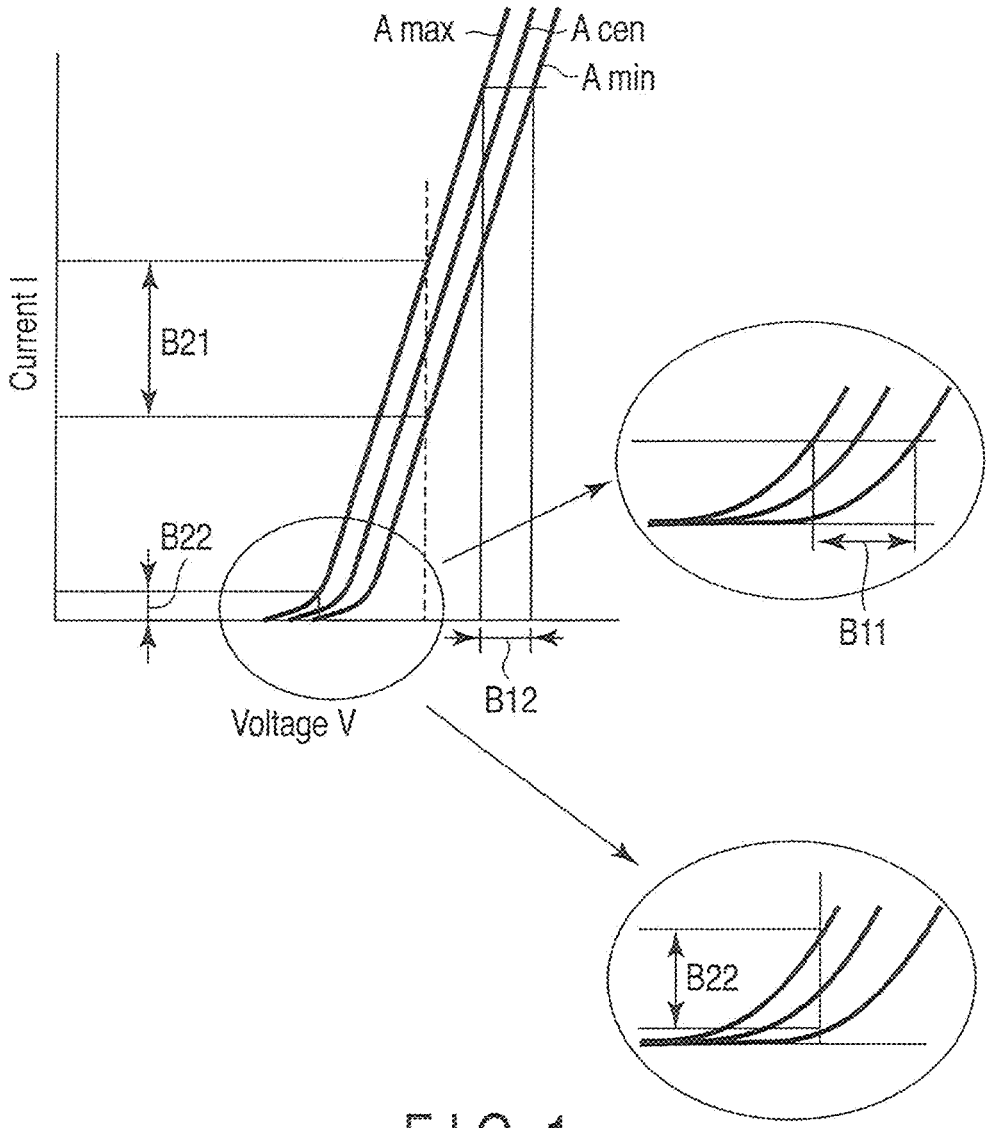
FIG. 1 is a graph illustrating a V-I characteristic of light-emitting diodes for describing a principle of dimmer control according to the present invention.

The light-emitting diodes as semiconductor light emitting modules, as is well known, has a V-I characteristic shown in FIG. 1. The V-I characteristic is expressed by a curve such that as a voltage V increases, an electric current I rises exponentially as shown in FIG. 1. It is known that the V-I characteristic is not uniform in all the light-emitting diodes, and curves are determined for the respective light-emitting diodes within an area between a curve Amax and a curve Amin where a curve Acen is the center according to variation in semiconductor elements of the respective light-emitting diodes or variation in operation points relating to a temperature characteristic.

If the light-emitting diodes are controlled so that a constant current flows in the light-emitting diodes, in a range where an increase of the electric current ΔI (ΔI/ΔV) with respect to an increase of the voltage ΔV is small, a voltage varies with respect to a certain electric current within an operation area B11. On the contrary, in a range where the increase of the electric current ΔI (ΔI/ΔV) with respect to the increase of the voltage ΔV is large, the voltage varies with respect to a certain electric current within an operation area B12. The operation area B12 where the voltage varies becomes smaller than the operation area B11 where the voltage varies. Therefore, when a constant current control mode is applied in an operation area where a dimmer level is shallow and a comparatively large current flows in the light-emitting diodes, namely, in a control area where a dimmer rate is small and the comparatively large current flows in the light-emitting diodes and the light-emitting diodes emit light at comparatively high brightness, variation of dimmer brightness can be decreased. As a result, in the dimmer control of the light-emitting diodes, a fluctuation in light output can be effectively suppressed.

On the other hand, when the light-emitting diodes are controlled by a constant voltage, in the range where the increase of the electric current ΔI (ΔI/ΔV) with respect to the increase of the voltage ΔV is large, the electric current varies with respect to a certain constant voltage within an operation area B21. On the contrary, in the range where the increase of the electric current ΔI (ΔI/ΔV) with respect to the increase of the voltage ΔV is small, the electric current varies with respect to a certain constant voltage within an operation area B22. The variation operation area B22 can be smaller than the variation operation area B21. Therefore, the constant voltage control mode is applied in an operation area where the dimmer level is deep and a comparatively small current flows in the light-emitting diodes, namely, in a control area where the dimmer rate is large and the comparatively small current flows in the light-emitting diodes and the light-emitting diodes emit light at comparatively low brightness, variation of the dimmer brightness can be decreased. As a result, in the dimmer control of the light-emitting diodes, a fluctuation in light output from the light-emitting diodes can be effectively suppressed.

Figure 2:
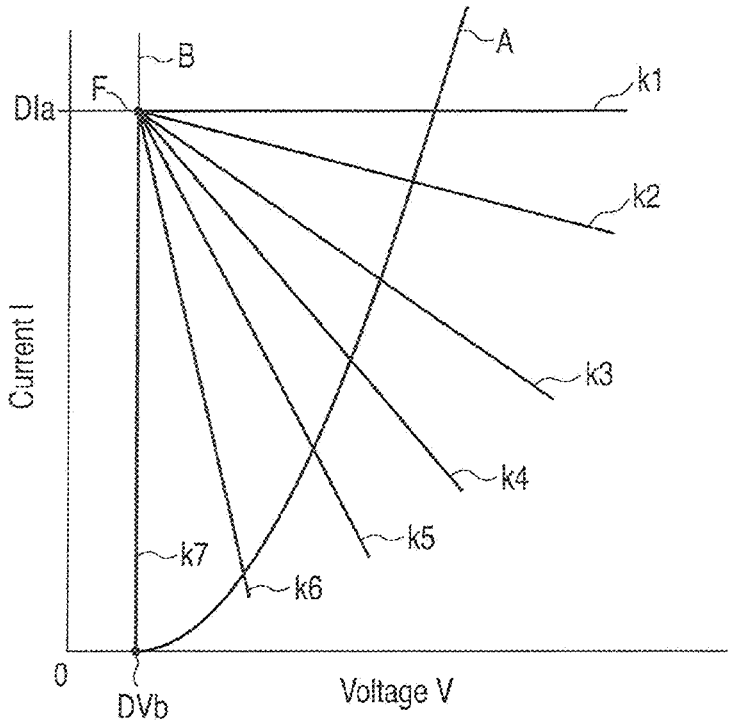
FIG. 2 is a graph showing a load characteristic in the power supply unit having a dimmer control function according to one embodiment of the present invention.

According to the above characteristic, in the power supply unit of the present invention, in the operation area where the dimmer rate is small (the dimmer level is shallow) and a large electric current flows in the light-emitting diodes, the light-emitting diodes are controlled in the constant current control mode, and in the area where the dimmer rate is large (the dimmer level is deep) and a small electric current flows in the light-emitting diodes, the light-emitting diodes are controlled in the constant voltage control mode. As the power supply unit which realizes such an operation, the power supply unit is operated by load characteristic (V-I characteristic) which varies according to the dimmer rate k1, k2, . . . k7 of the dimmer signal k as shown in FIG. 2. The dimmer rate k1, k2, . . . k7 is set with a range of the smallest dimmer rate k1 to the largest dimmer rate k7. In this power supply unit, when an ON voltage at which the light-emitting diodes start conduction of an electric current is defined as DVb and an all-optic light emitting current at the time of all-optic light emission is defined as DIa and the ON voltage DVb and the all-optic light emitting current DIa are reference s, the load characteristics according to the dimmer rates k1, k2, . . . k7 are set to a radial straight line where an intersection F (constant value) where V=DVb and I=DIa is the center. For example, the load characteristic with respect to the dimmer rate k1 is a constant current characteristic which is approximately parallel with a voltage axis (V), and the load characteristics with respect to the dimmer rates k2 to k6 are such that an angle with respect to a current axis (I) around the intersection F is made to be smaller towards the dimmer rate k6 and a tendency of the constant voltage characteristic is strengthened. Further, the load characteristic with respect to the dimmer rate k7 is a constant voltage characteristic which is approximately parallel with the current axis (I).

The load characteristics with respect to the dimmer rates k1, k2, . . . k7 can be expressed by a linear function of I=DIa . . . k(V). That is, the above formula is I+k(V)=DIa . . . (1), and a relationship holds as follows. The load, namely, a value, which is obtained by adding a current detected value in the light-emitting diodes and a load voltage detected value and an operated result of a dimmer signal voltage, becomes a constant current value DIa. The power supply unit according to first to third embodiments described below is constituted so that this relational expression holds.

From another viewpoint, the load characteristics with respect to the dimmer rates k1, k2, . . . k7 can be expressed by a linear function of V=DVb−k(I). That is, this formula is V+k(I)=DVb . . . (2), and a relationship holds as follows. The load, namely, the value, which is obtained by adding the operated result of the dimmer signal voltage to the load voltage detected value and the current detected value in the light-emitting diodes, becomes a constant voltage value DVb.

The power supply unit according to the embodiments of the present invention based on such an operation principle is realized as follows.

(First Embodiment)

Figure 3:
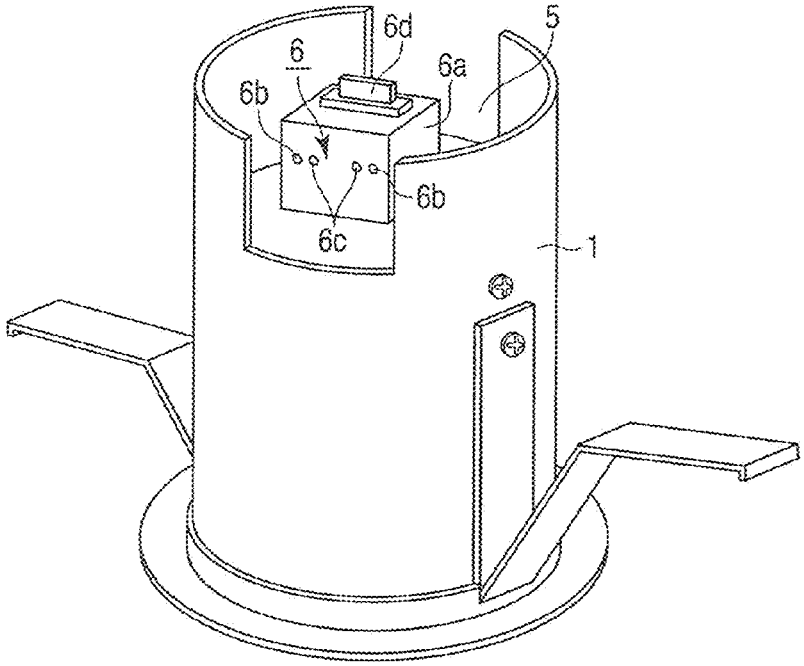
FIG. 3 is a perspective view schematically illustrating a lighting unit having the power supply unit according to a first embodiment of the present invention.
Figure 4:
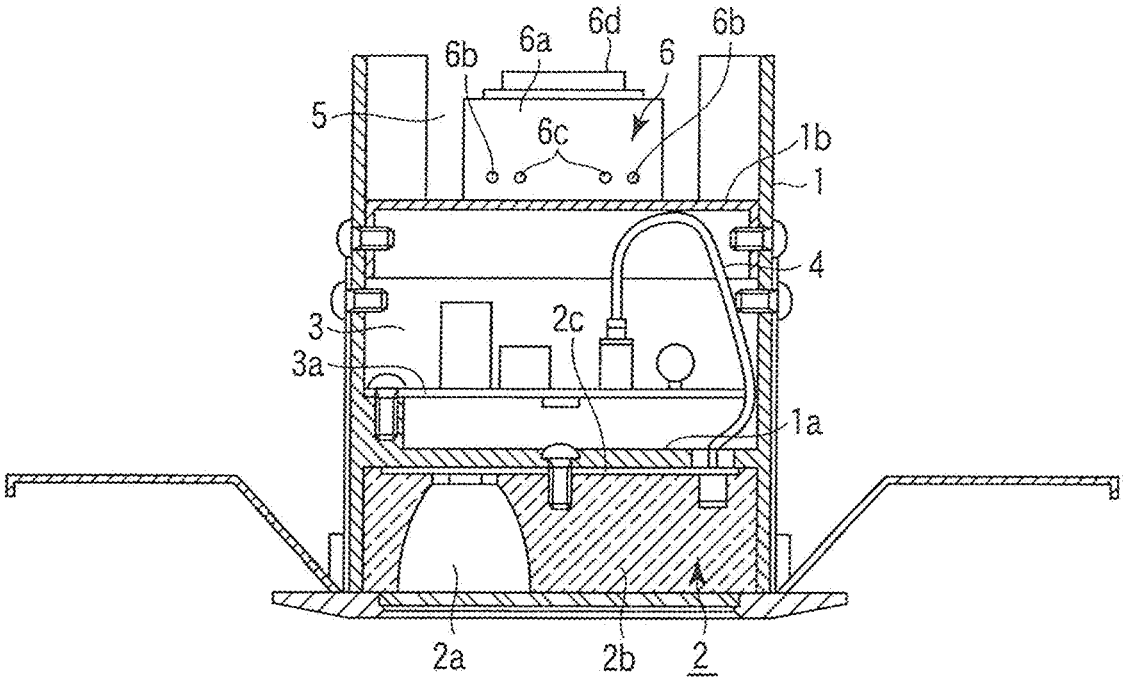
FIG. 4 is a cross-sectional view schematically illustrating an internal constitution of the lighting unit shown in FIG. 3.

The lighting unit to which the power supply unit of the present invention is applied will be simply described. In FIGS. 3 and 4, a symbol 1 denotes a unit main body, and the unit main body 1 is made of aluminum die-casting, and is formed into a cylindrical shape whose both ends are opened. The inside of the unit main body 1 is, as shown in FIG. 4, divided into three spaces along an up-down direction by partition members 1*a* and 1*b*. A lower space between a lower opening and the partition member la is allocated to a light source section 2. The light source section 2 is provided with a plurality of LEDs 2*a* as semiconductor light emitting modules and a reflecting body 2*b*. The plurality of LEDs 2*a* is arranged with equal intervals along a peripheral direction of a disc-shaped wiring substrate 2*c* provided on a lower surface of the partition member 1*a*, and is mounted onto the wiring substrate 2*c*. That is, the plurality of LEDs 2*a* is arranged into a peripheral shape with the equal intervals around a center axis of the cylindrical unit main body 1.

A space in the middle between the partition members 1*a* and 1*b* of the unit main body 1 is allocated to a power supply chamber 3. In the power supply chamber 3, a wiring substrate 3*a* is arranged on the partition member 1*a*. The wiring substrate 3*a* is provided with electronic parts composing the power supply unit for driving the plurality of LEDs 2*a*. The power supply unit and the plurality of LEDs 2*a* are connected by a lead wire 4.

An upper space between the partition member 1*b* of the unit main body 1 and an upper opening is allocated to a power supply terminal chamber 5. In the power supply terminal chamber 5, a power supply terminal table 6 is provided to the partition member 1*b*. The power supply terminal table 6 is provided in order to supply an AC power of a commercial power to the power supply unit in the power supply chamber 3. The power supply terminal table 6 has a box 6*a* made of insulating synthetic resin, and an outlet 6*b* to be a power supply cable terminal section is provided to both surfaces of the box 6*a*. An outlet 6*c* to be a feed cable terminal section and a release button 6*d* which disconnects a power supply line and a feed line are provided to the box 6*a*.

Figure 5:
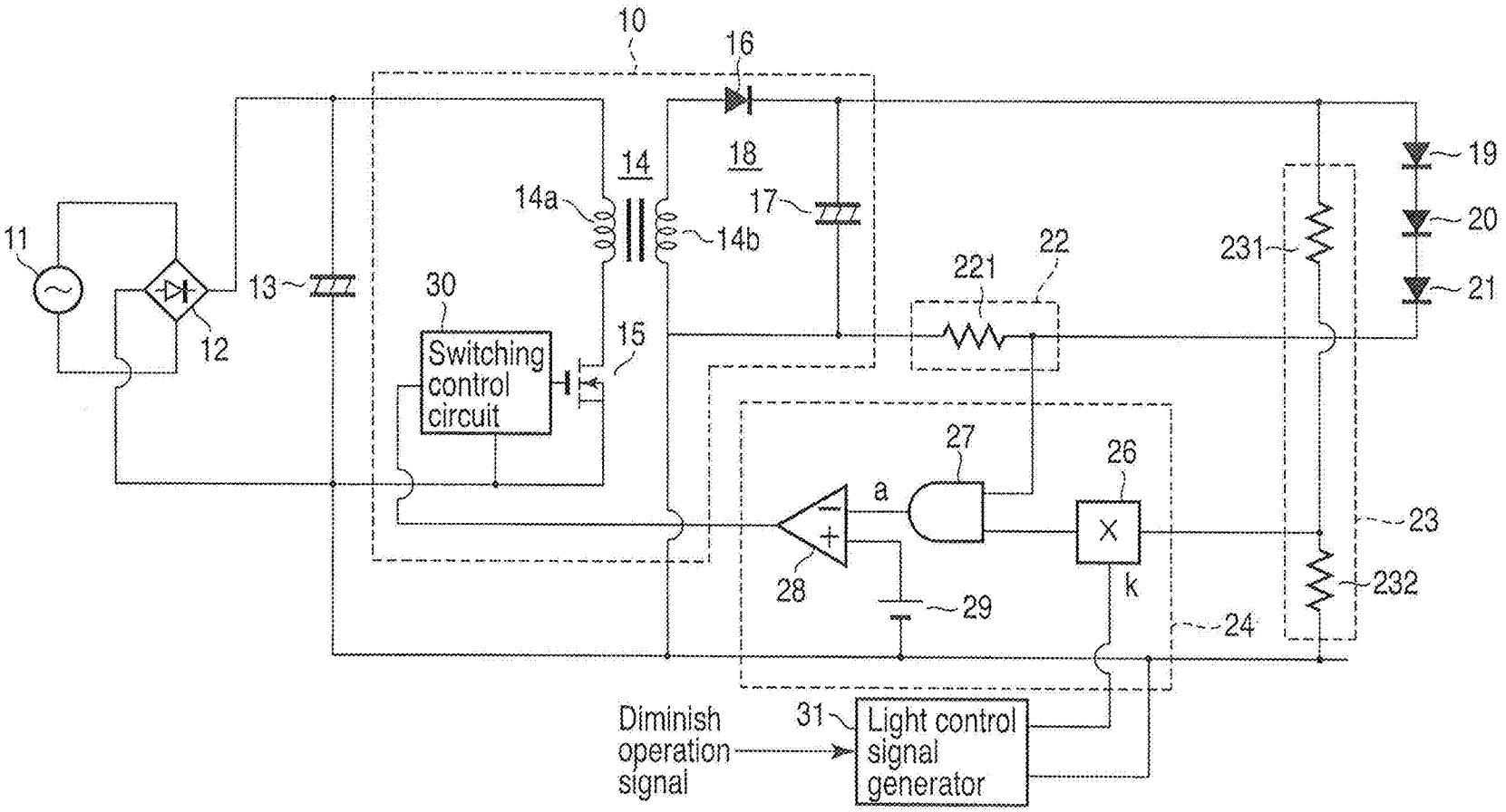
FIG. 5 is a circuit diagram illustrating a circuit configuration of the power supply unit according to the first embodiment of the present invention.

FIG. 5 illustrates a circuit configuration of the power supply unit according to the first embodiment of the present invention incorporated into the power supply chamber 3 of the lighting unit shown in FIG. 4.

In FIG. 5, a symbol 11 denotes an AC power supply, and the AC power supply 11 is composed of a commercial power supply. The AC power supply 11 is connected to an input terminal of a full-wave rectifying circuit 12. The full-wave rectifying circuit 12 generates an output obtained by full-wave rectifying an AC power from the AC power supply 11. A smoothing capacitor 13 is connected between positive and negative output terminals of the full-wave rectifying circuit 12, and smoothens a DC power rectified by the full-wave rectifying circuit 12 so as to output the smoothened output.

The full-wave rectifying circuit 12 and the smoothening capacitor 13 compose the DC power supply.

As the DC power supply, a circuit which rectifies and smoothens an AC voltage from the commercial power supply is used, but a power factor improving converter which improves a power factor may be used.

The smoothening capacitor 13 is connected to a DC-DC converter 10. The DC-DC converter 10 is composed of a switching transformer 14 as a flyback transformer and a switching transistor 15 which switches an output voltage from the smoothening capacitor 13. The switching transformer 14 has a primary winding 14*a* and a secondary winding 14*b* which is magnetically coupled with the primary winding 14*a*. A primary side of the switching transformer 14 is connected to the smoothening capacitor 13 via the switching transistor 15. That is, both ends of the smoothening capacitor 13 are connected to the primary winding 14*a* of the switching transformer 14 and a series circuit of the switching transistor 15.

The DC-DC converter 10 includes a rectifying smoothening circuit 18 composed of a diode 16 which rectifies a voltage generated on the secondary side of the switching transformer 14 and a smoothening capacitor 17 for smoothening a rectified voltage, and a control circuit 30. The secondary winding 14*b* of the switching transformer 14 is connected to the rectifying smoothening circuit 18 composed of the diode 16 of polarity shown in the drawing and the smoothening capacitor 17. The rectifying smoothening circuit 18 as well as the switching transistor 15 and the switching transformer 14 composes a converter circuit which generates and output a DC output. In the converter circuit, an alternating voltage obtained by switching (on/off) the DC voltage by the switching transistor 15 is applied to the primary winding 14*a* of the switching transformer 14. An alternating output is generated on the secondary winding 14*b* of the switching transformer 14. This alternating output is rectified by the diode 16, and the rectified output is smoothened by the smoothening capacitor 17 so as to be output as the DC output.

In addition, in the embodiment described above, a power supply part which control the brightness of the light emitting diodes is composed of the AC power supply 11, the full-wave rectifying circuit 12, the smoothing capacitor 13, the DC-DC converter 10, and the rectifying smoothening circuit 18.

In the first embodiment, the flyback converter is used as the DC-DC converter 10. Instead of the flyback converter, when the voltage on the load side is lower than the power supply voltage, a step-down converter may be used as the DC-DC converter 10. When the voltage on the load side is higher than the power supply voltage, a step-up converter or a step-up/step-down converter may be used as the DC-DC converter 10. The converter 10 may be realized by any circuit configuration as long as an output can be varied according to a state of the load or an external signal.

A plurality of light-emitting diodes 19 to 21 (in this example, three) is connected in series as semiconductor light emitting modules of the load to both the ends of the smoothening capacitor 17 of the rectifying smoothening circuit 18 composing the DC-DC converter 10. The light-emitting diodes 19 to 21 correspond to the LED 2*a* shown in FIG. 2.

The series circuit of the light-emitting diodes 19 to 21 is connected to a current detecting circuit 22 in series. The current detecting circuit 22 is composed of a resistor 221 as an impedance element, and detects an electric current (load current) flowing in the light-emitting diodes 19 to 21 so as to output a current detected signal I. The series circuit of the light-emitting diodes 19 to 21 is connected to a load voltage detecting circuit 23 in parallel. The load voltage detecting circuit 23 is composed of a series circuit of resistors 231 and 232 as impedance elements, and detects a load voltage to be applied to the light-emitting diodes 19 to 21, so as to output the load voltage V as a load voltage signal.

The load voltage detecting circuit 23 is a voltage divider with resistors 231 and 232 dividing the voltage applied to the load. For example, an operating voltage may be present at the anode of the first diode 19 of the array of diodes 19, 20, 21. This operating voltage may also be applied to the load voltage detecting circuit 23. Because the resistances of the resistors 231 and 232 are known, the operating voltage may be determined based on the output of the load voltage detecting circuit 23.

The current detected signal I and the load voltage signal V are input into the current detecting circuit 22 and the load voltage detecting circuit 23, respectively, and a signal control section 24 which outputs a control signal according to these input signals is connected thereto. The signal control section 24 is composed of a multiplier 26, an adder 27, and a comparator 28. The load voltage signal V from the load voltage detecting circuit 23 and a dimmer signal k from a dimmer signal generator 31 are input into the multiplier 26. The multiplier 26 outputs a multiplied signal obtained by multiplying the load voltage signal V by the dimmer signal k. Details of the multiplier 26 will be described later. The adder 27 adds the multiplied signal output from the multiplier 26 to the current detected signal I from the current detecting circuit 22 so as to generate an added output DIa. The comparator 28 compares the output DIa from the adder 27 with a constant reference value 29, so as to output a compared result as a control signal.

The dimmer signal generator 31 generates the dimmer signal k based on an external dimmer operation signal. The dimmer signal k is generated as a PWM signal which is selected according to a dimmer rate (dimmer level) and has a different duty ratio. The duty ratio is defined as a value obtained by dividing the pulse width of the PWM signal by a pulse cycle as is well known. The external dimmer operation signal is input as a signal for specifying the dimmer level, namely, the dimmer rate into the dimmer signal generator 31. The dimmer signal generator 31 has a table where the dimmer rate and the duty ratio have a correlation with each other, this table is seen as to the dimmer rate specified by the dimmer operation signal so that a duty ratio is determined, and a PWM signal having this duty ratio is output from the dimmer signal generator 31 to the multiplier 26.

The dimmer signal k is varied within a duty ratio range of 0 to 100% in such a manner that an upper limit of dimmer corresponding to the smallest dimmer rate k1 in the full-emission state is set at the duty ratio of 0%, and the brightness is the lowest and a lower limit of dimmer corresponding to the largest dimmer rate k7 is set at the duty ratio of 100%. The dimmer signal k whose duty ratio is 0% corresponds to a low-level DC signal, and the dimmer signal k whose duty ratio is 100% corresponds to a high-level DC voltage. The dimmer signal is generated at the duty ratio depending on the dimmer rates k1, k2, . . . k7 (k1<k2, . . . <k7).

Figure 6:
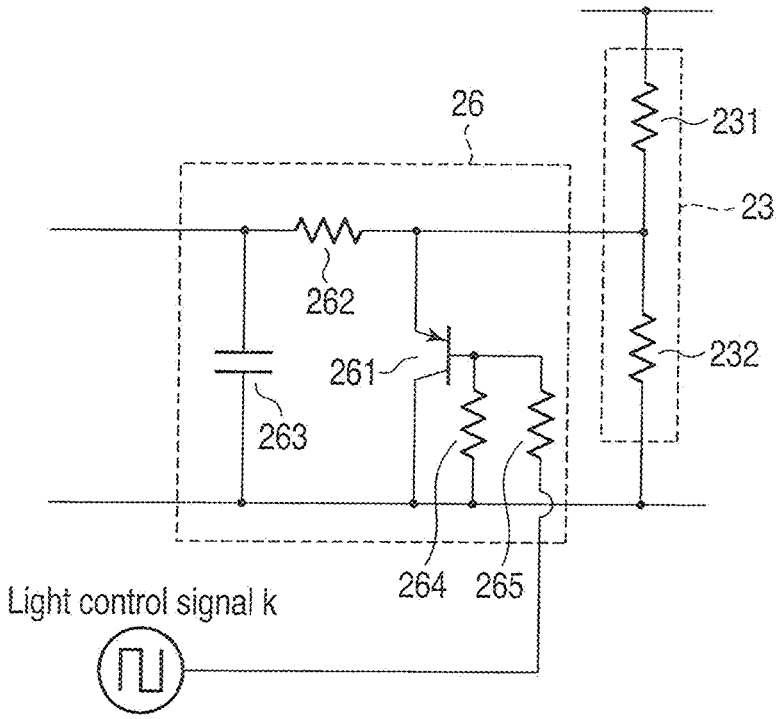
FIG. 6 is a circuit diagram schematically illustrating a circuit configuration of a multiplier applied to the power supply unit shown in FIG. 5.

In the multiplier 26, as shown in FIG. 6, an emitter-collector of a transistor 261 as a switching element is connected to the resistor 232 of the load voltage detecting circuit 23 in parallel, and a series circuit of the resistor 262 and the capacitor 263 as a charging element is connected to the transistor 261 in parallel. In the transistor 261, an emitter is connected to a connection point between the resistor 232 and the resistor 262, and a collector is connected to a connection point between the resistor 232 and the capacitor 263. In the transistor 261, a resistor 264 is connected between a base and the collector, and the base is connected to the dimmer signal generator 31 via a resistor 265 so that the dimmer signal k from the dimmer signal generator 31 is input into the base.

Figure 7:
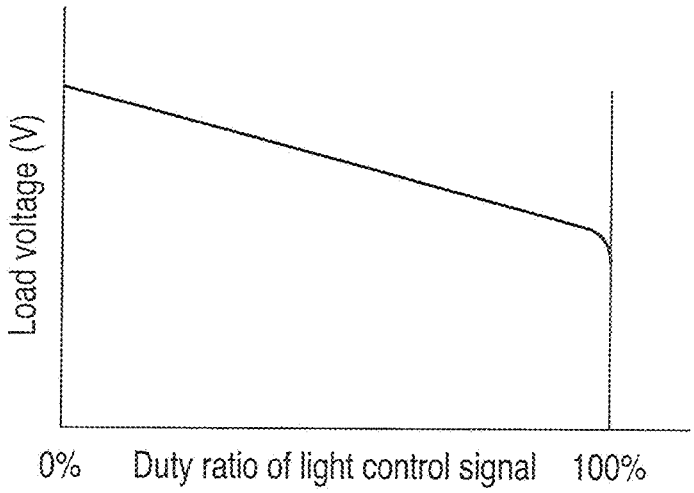
FIG. 7 is a graph illustrating a change in a forward voltage of the light-emitting diodes applied to the power supply unit shown in FIG. 5.
Figure 8:
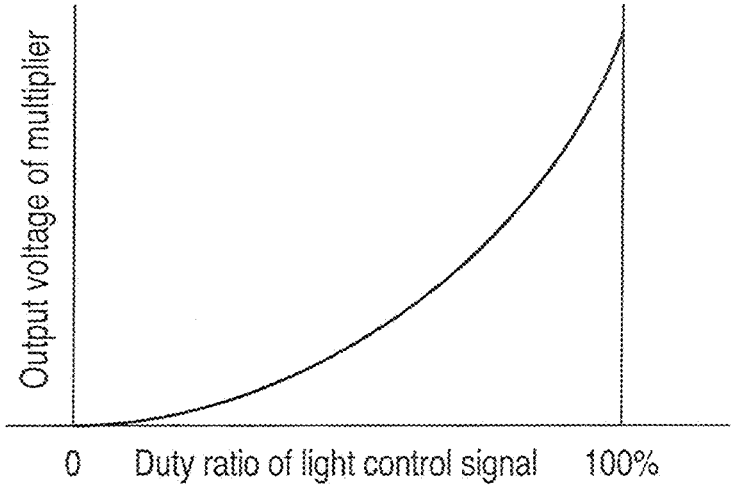
FIG. 8 is a graph illustrating an output voltage of the multiplier applied to the power supply unit shown in FIG. 5.

In the multiplier 26 constituted in such a manner, the transistor 261 is turned on/off by the dimmer signal k. Therefore, the capacitor 263 is charged with the output voltage (load voltage V) from the resistor 232 of the load voltage detecting circuit 23 according to the duty ratio of the dimmer signal k, and the charged voltage is generated as an output voltage from the multiplier 26. More concretely, the PWM signal of the dimmer signal k is set to a dimmer upper limit (full-emission state) at the duty ratio of 0%, and set to a dimmer lower limit at the duty ratio of 100%. In the circuit shown in FIG. 5, an electric current flowing in the light-emitting diodes 19 to 21 is increased or decreased approximately linearly with respect to the change in the duty ratio of the dimmer signal k. A forward voltage (load voltage) of the light-emitting diodes 19 to 21 is reduced approximately linearly from the dimmer upper limit (0%) to the dimmer lower limit (100%) as shown in FIG. 7. In the full-emission state where the duty ratio of the dimmer signal k is 0%, the transistor 261 is maintained ON. Therefore, the transistor 261 short-circuits both ends of the resistors 232 of the load voltage detecting circuit 23, and the capacitor 263 is not charged, and a charging voltage value of the capacitor 263 is 0, and the output voltage from the multiplier 26 also becomes 0. Further, when the dimmer rate of the dimmer signal k is changed and the duty ratio is set large, the transistor 261 is turned on/off according to the duty ratio at this time. When the PWM signal is off, the transistor 261 is turned on, and when the PWM signal is on, the transistor 261 is turned off. The output voltage (load voltage V) from the resistor 232 of the load voltage detecting circuit 23 is applied to the capacitor 263 for a period where the transistor 261 is off. Therefore, the capacitor 263 is charged, the charging value at this time is generated as the output voltage from the multiplier 26 and is output. When the duty ratio of the dimmer signal k is set larger and the dimmer is the lower limit (100%), the transistor 261 is maintained off. Therefore, the entire output voltage (load voltage V) from the resistor 232 of the load voltage detecting circuit 23 is applied to the capacitor 263, and the capacitor 263 is charged. Therefore, a large charging voltage value is generated from the capacitor 263 as the output voltage from the multiplier 26. With such a series of operation, the output voltage from the multiplier 26 is changed so that a quadratic curve is drawn with respect to the duty ratio (0% to 100%) of the dimmer signal k shown in FIG. 8.

In the circuit shown in FIG. 5, the comparator 28 is connected to the control circuit 30 which controls the switching transistor 15, and a voltage signal is supplied from the comparator 28 thereto. The control circuit 30 is driven by a power supply section, not shown, and the comparator 28 generates a switching control signal according to a voltage signal. The switching transistor 15 is turned on/off by the switching control signal from the control circuit 30, the switching transformer 14 is switching-driven, and outputs to be supplied to the light-emitting diodes 19 to 21 from the rectifying smoothening circuit 18 are controlled. The control circuit 30 controls the outputs to be supplied to the light-emitting diodes 19 to 20 based on an output from the comparator 28 of the control section 24, namely, an output value DIa obtained by adding the output from the multiplier 26 and the current detected signal I from the current detecting circuit 22 by the adder 27 so that the value DIa always becomes constant.

The control circuit 30 has a memory (not shown), and a table in the memory is referred to by the output voltage of the comparator 28. A switching waveform of the switching control signal, namely, the duty ratio of the PWM control signal is selected, and the switching control signal having the selected duty ratio is applied to the gate of the switching transistor 15.

The dimmer operation in the power supply circuit shown in FIG. 5 will be described below.

The load characteristics corresponding to the dimmer rates k1, k2, . . . k7 of the power supply unit and the V-I characteristic A of the light-emitting diodes 19 to 21 establish a relationship shown in FIG. 2.

At first, when the dimmer signal generator 31 outputs the dimmer signal k of the upper limit (all-optic) at the duty ratio of 0% based on an external dimmer operation signal, a load characteristic corresponding to the dimmer rate k1 shown in FIG. 2 is obtained according to the dimmer signal k at this time. When the duty ratio of the dimmer signal k is set to 0%, the transistor 261 of the multiplier 26 is maintained on in the control section 24, and both the ends of the resistors 232 of the load voltage detecting circuit 23 are short-circuited by the transistor 261. Therefore, the charging voltage value of the capacitor 263 is 0, and the output voltage from the multiplier 26 is also 0. Therefore, the output value DIa from the adder 27 depends only on the current detected signal I detected by the current detecting circuit 22, and is weighted by the current detected signal I. The control circuit 30 makes constant current control based on the output from the comparator 28 so that the electric currents flowing in the light-emitting diodes 19 to 21 become constant. That is, in the formula (1), since a k (V) component which determines the output value DIa is approximately 0 and the light-emitting diodes 19 to 21 are influenced only by an I component, the lighting of the light-emitting diodes 19 to 21 is controlled according to the constant current characteristic.

In the lighting control according to the constant current characteristic, when the control circuit 30 turns on/off the switching transistor 15, the switching of the switching transformer 14 is driven. When the switching transistor 15 is turned on, an electric current flows in the primary winding 14*a* of the switching transformer 14 and energy is accumulated, and when the switching transistor 15 is turned off, the energy accumulated on the primary winding 14*a* is discharged through the secondary winding 14*b*. The discharge of the energy generates a DC output in the rectifying smoothening circuit 18, and the light-emitting diodes 19 to 21 are lighted by the DC output.

When the dimmer rate of the dimmer signal k is changed and the duty ratio is set large, any one of the load characteristics corresponding to the dimmer rates k2 to k6 shown in FIG. 2 is set according to the duty ratio of the dimmer signal k. When the duty ratio of the dimmer signal k is set large, the transistor 261 of the multiplier 26 is turned on/off according to the duty ratio at this time. When the PWM signal is off, the transistor 261 is turned on, and when the PWM signal is on, the transistor 261 is turned off. For the period during which the transistor 261 is off, the capacitor 263 is charged with the output voltage from the resistor 232 of the load voltage detecting circuit 23, namely, the load voltage V, and this charging voltage value is generated as the output voltage from the multiplier 26. The adder 27 outputs the added output DIa obtained by adding the multiplied signal output from the multiplier 26 to the current detected signal I from the current detecting circuit 22. Therefore, as the duty ratio of the dimmer signal k becomes larger and the output voltage from the multiplier 26 becomes larger, a proportion of the current detected signal I of the current detecting circuit 22 to the added output DIa is suppressed, and a proportion of the output voltage (load voltage V) of the load voltage detecting circuit 23 to the added output DIa becomes large, and the added output DIa weighted by the output voltage is output. The control circuit 30 generates a switching signal so as to control the light-emitting diodes 19 to 21 based on the output signal from the comparator 28. For this reason, a tendency for the control to give the constant voltage characteristic, in which the voltages become constant, to the light-emitting diodes 19 to 21 is gradually stronger than a tendency for the control to give the constant current characteristic thereto. That is, when the dimmer signal k is changed into the dimmer rate k2 to k6, in the formula (1), the k (V) component for determining DIa gradually becomes larger from 0, and the I component is reduced according to the increase in the k (V) component. As a result, the tendency for the control to give the constant voltage characteristic is stronger than the tendency for the control to give the constant current characteristic, and the lighting of the light-emitting diodes 19 to 21 is controlled.

Thereafter, the dimmer signal generator 31 outputs the dimmer signal k of the lower limit at the duty ratio of 100%, the load characteristic corresponding to the dimmer rate k7 shown in FIG. 2 is set according to this dimmer signal k.

In this setting, duty ratio of 100% is given to the dimmer signal k, and the transistor 261 of the multiplier 26 is maintained off in the control section 24. Therefore, the entire output voltage (load voltage V) from the resistor 232 of the load voltage detecting circuit 23 is applied to the capacitor 263, and the capacitor 263 is charged. A voltage with a large charging value is generated as the output voltage of the multiplier 26 from the capacitor 263. As a result, the output value DIa from the adder 27 is influenced only by the output voltage (load voltage V) of the load voltage detecting circuit 23, and the control circuit 30 generates a switching signal so as to control the light-emitting diodes 19 to 21 based on the output signal from the comparator 28. As a result, the control circuit 30 controls the light-emitting diodes 19 to 21 under the constant voltage control such that the voltages to be applied to the light-emitting diodes 19 to 21 are approximately constant. That is, since the k (V) component for determining DIa are mostly present and the I component is approximately 0 in the formula (1), the lighting of the light-emitting diodes 19 to 21 is controlled by the constant voltage characteristic.

In the above control system, when the dimmer signal k of the dimmer signal generator 31 is change within the range of the dimmer rates k1, k2, . . . k7, in the operation area where the dimmer rate is small, the lighting of the light-emitting diodes 19 to 21 is controlled by the constant current characteristic according to the load characteristics corresponding to the dimmer rates k1, k2, . . . k7. As the dimmer rate becomes larger, the tendency for the constant voltage characteristic becomes gradually stronger than the constant current characteristic, so that the lighting of the light-emitting diodes 19 to 21 is controlled. The transition of the dimmer control system by means of the constant current characteristic and the constant voltage characteristic can be performed only by changing the dimmer rate (dimmer level) of the dimmer signal k, and thus the stable dimmer control can be realized within the wide range of the operation area of the small dimmer rate to the operation area of the large dimmer rate.

Since the dimmer control does not use a control system for directly controlling a pulse width, flicker can be prevented from occurring on the light outputs from the light-emitting diodes in the light supply unit unlike the power supply unit which makes the dimmer control according to a pulse width disclosed in JP-A 2003-157986 (KOKAI). Further, since a switching element is not necessary for the dimmer control, the circuit configuration of the power supply unit is simplified so that the number of parts can be reduced, miniaturization and lower price of the power supply unit can be realized, and deterioration of the circuit efficiency can be suppressed.

As described above with reference to FIG. 1, the constant current control is applied to the operation area where a comparatively large electric current flows in the light-emitting diodes 19 to 21 with the small dimmer rate. Therefore, an influence of the variation in the characteristic of the light-emitting diodes 19 to 21 on the dimmer control can be reduced, and the fluctuation in the light outputs from the light-emitting diodes 19 to 21 can be suppressed. The constant voltage control is applied to the operation area where a small electric current flows in the light-emitting diodes 19 to 21 with the large dimmer rate. Therefore, the influence of the variation in the characteristic of the light-emitting diodes 19 to 21 can be reduced, and the fluctuation in the light outputs from the light-emitting diodes can be also suppressed. As a result, the fluctuation in the light outputs caused by the variation in the light-emitting diodes 19 to 21 and the variation in the operation points due to the temperature characteristics can be suppressed as much as possible.

(Second Embodiment)

Figure 10:
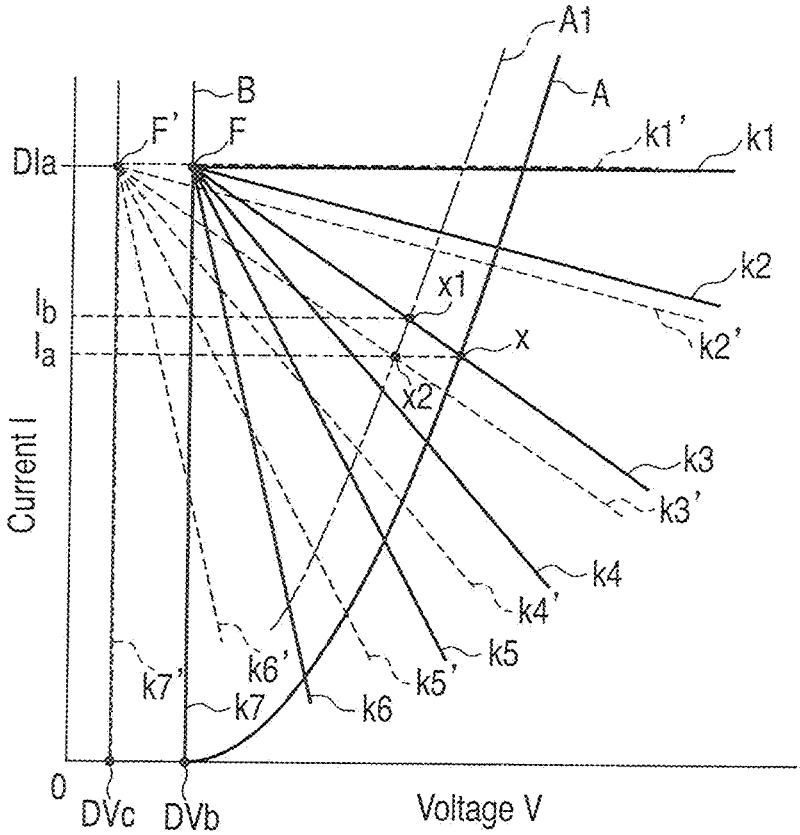
FIG. 10 is a graph showing an operation of the power supply unit shown in FIG. 9.

If the number of the connected light-emitting diodes composed of the semiconductor light emitting modules as a load is increased or decreased or different types of light-emitting diodes are used, the electric current flowing in the light-emitting diodes is changed so that the light output (brightness) occasionally changes. It is assumed that a certain light-emitting diode has a V-I characteristic A shown in FIG. 10, the power supply unit is set to the dimmer rate k3, and the light-emitting diode is operated at a point x where the dimmer rate k3 intersects with the load characteristics. In this operation state, when the number of light-emitting diodes connected to that light-emitting diode is changed, the V-I characteristic A of that light-emitting diode is changed into a characteristic shown by a curve A1 shown in FIG. 10. According to the change in the V-I characteristic A, an operation point which intersects the load characteristic corresponding to the dimmer rate k3 is moved from x to x1 as shown in FIG. 10, the electric current flowing in the light-emitting diode is changed from Ia into Ib, and the light outputs (brightness) from the light-emitting diodes are changed.

In the power supply unit according to the second embodiment, the constant light outputs (brightness) can be always maintained at the set dimmer rate regardless of the changes in the number and the type of the connected light-emitting diodes.

Figure 9:
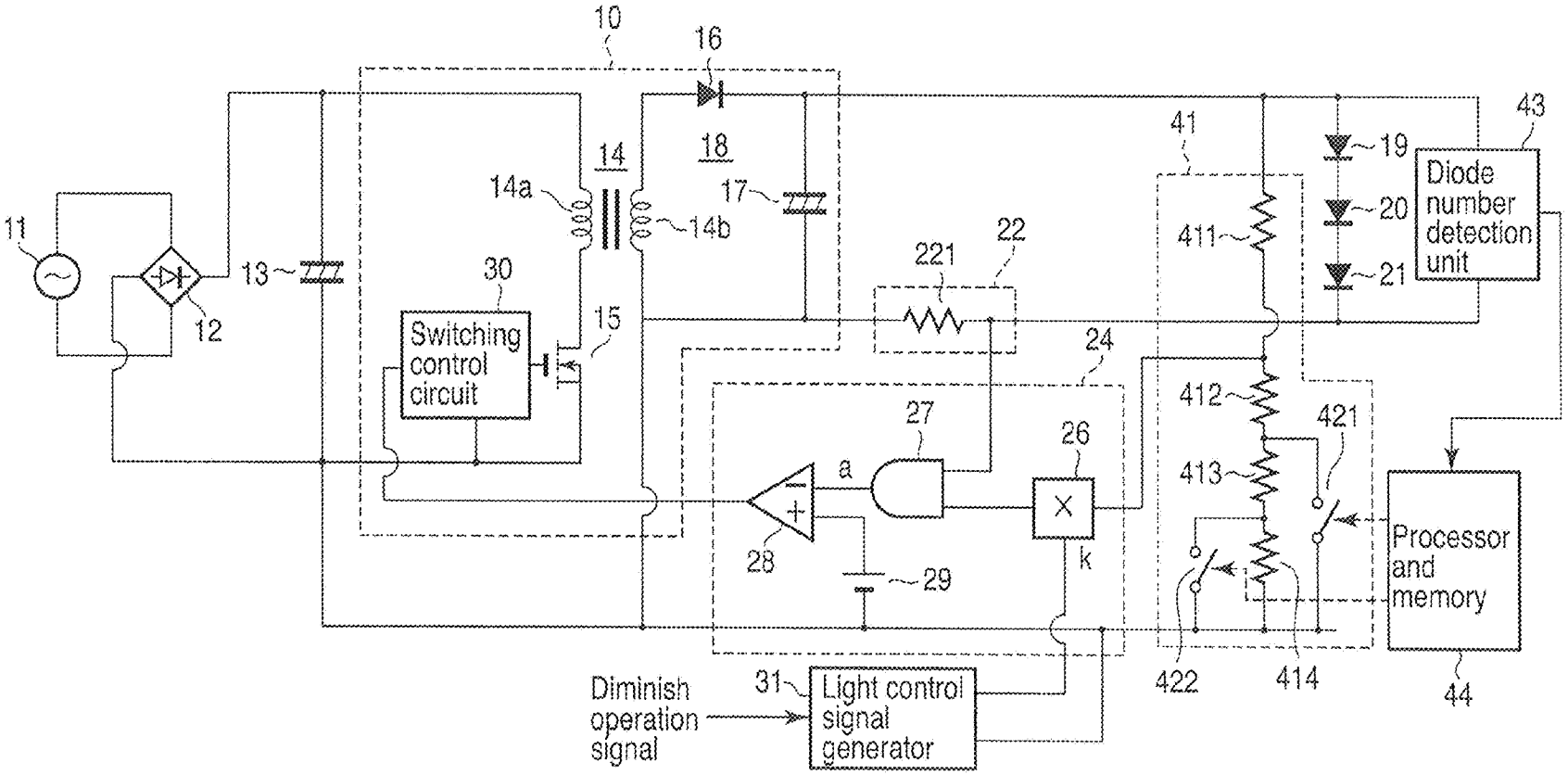
FIG. 9 is a circuit diagram schematically illustrating a circuit configuration of the power supply unit according to a second embodiment of the present invention.

FIG. 9 illustrates a schematic constitution of the power supply unit according to the second embodiment of the present invention, and the same parts as those in FIG. 5 are denoted by the same symbols.

In the unit shown in FIG. 9, the load voltage detecting circuit 41, which is connected to the light-emitting diodes 19 to 21 in parallel, has a series circuit of resistors 411, 412, 413 and 414, and the multiplier 26 is connected to a connection point in the series circuit of the resistors 412, 413 and 414. A switching element 421 is connected to the series circuit of the resistors 413 and 414 in parallel, and a switching element 422 is connected to the resistor 414. These switching elements 421 and 422 are changed over according to the number of the light-emitting diodes 19 to 21 connected in series. When all the light-emitting diodes 19 to 21 are connected and lighted, all the switching elements 421 and 422 are turned off. When the light-emitting diode 21 is disconnected from the series circuit and the light-emitting diodes 19 and 21 are connected in series and lighted, only the switching element 422 is turned on, and when only the light-emitting diode 19 is connected and lighted, only the switching element 421 is turned on. The on/off operation of the switching elements 421 and 422 is controlled by a microcomputer 44 based on a detected signal from a number detecting part 43 connected to the light-emitting diodes 19 to 21. The number detecting part 43 may detect resistance of the series circuit of the light-emitting diodes 19 to 21 so as to supply a detected signal representing the number of the light-emitting diodes 19 to 21 connected in series to the microprocessor 44. The microprocessor 44 may have a memory in which a table describing a relationship between the light-emitting diodes 19 to 21 and levels of the detected signals is stored. The microprocessor 44 refers to the memory by means of the detected signal and specifies the number of the light-emitting diodes 19 to 21 according to the detected signal so as to allow the switching elements 421 and 422 to be turned on/off according to the specified number.

As a result, in a state that all the light-emitting diodes 19 to 21 are connected, an intersection between the V-I characteristic A of the light-emitting diodes and a voltage axis (V) is at a point DVb as shown in FIG. 10. When the number of the connected light-emitting diodes is changed and only the light-emitting diodes 19 and 20 are connected in this state, the V-I characteristic of the light-emitting diodes is changed into A1. Therefore, the detected signal from the number detecting part 43 for detecting the connected state of the light-emitting diodes 19 and 20 is changed, and the microprocessor 44 detects a change in the number of the connected light-emitting diodes. Therefore, the microprocessor 44 turns on the switching element 422 according to the number of the connected light-emitting diodes (only the light-emitting diodes 19 and 20), and outputs a voltage of the series circuit of the resistors 412 and 413 as the load voltage V to the control section 24. As a result, as shown in FIG. 10, the intersection between the V-I characteristic A1 of the light-emitting diodes and the voltage axis (V) is moved to a point c in a left direction of the drawing, and the point F as a base point of the load characteristic is also moved to a point F'. Due to the movement of the base point, all the load characteristics corresponding to the dimmer rates k1 to k7 are moved parallel to the left direction as shown by symbols k1' to k7'. Since the load characteristic corresponding to the dimmer rate k3 is also moved parallel to a position k3' in the left direction of the drawing, the operation point which intersects with the V-I characteristic A1 of the light-emitting diodes is moved from a point x1 to a point x2, and the electric current flowing in the light-emitting diodes is corrected into Ia.

Therefore, also in the power supply unit according to the second embodiment, the similar effect to that of the first embodiment can be obtained, and even when the V-I characteristic changes due to the change in the number and the type of connected light-emitting diodes, the electric current flowing in the light-emitting diodes can be corrected to be constant, so that the constant light output can be always obtained.

(Third Embodiment)

Also in the power supply unit according to a third embodiment, similarly to the second embodiment, the constant light output (brightness) can be obtained according to the dimmer rate regardless of the change in the number and the type of connected light-emitting diodes.

Figure 11:
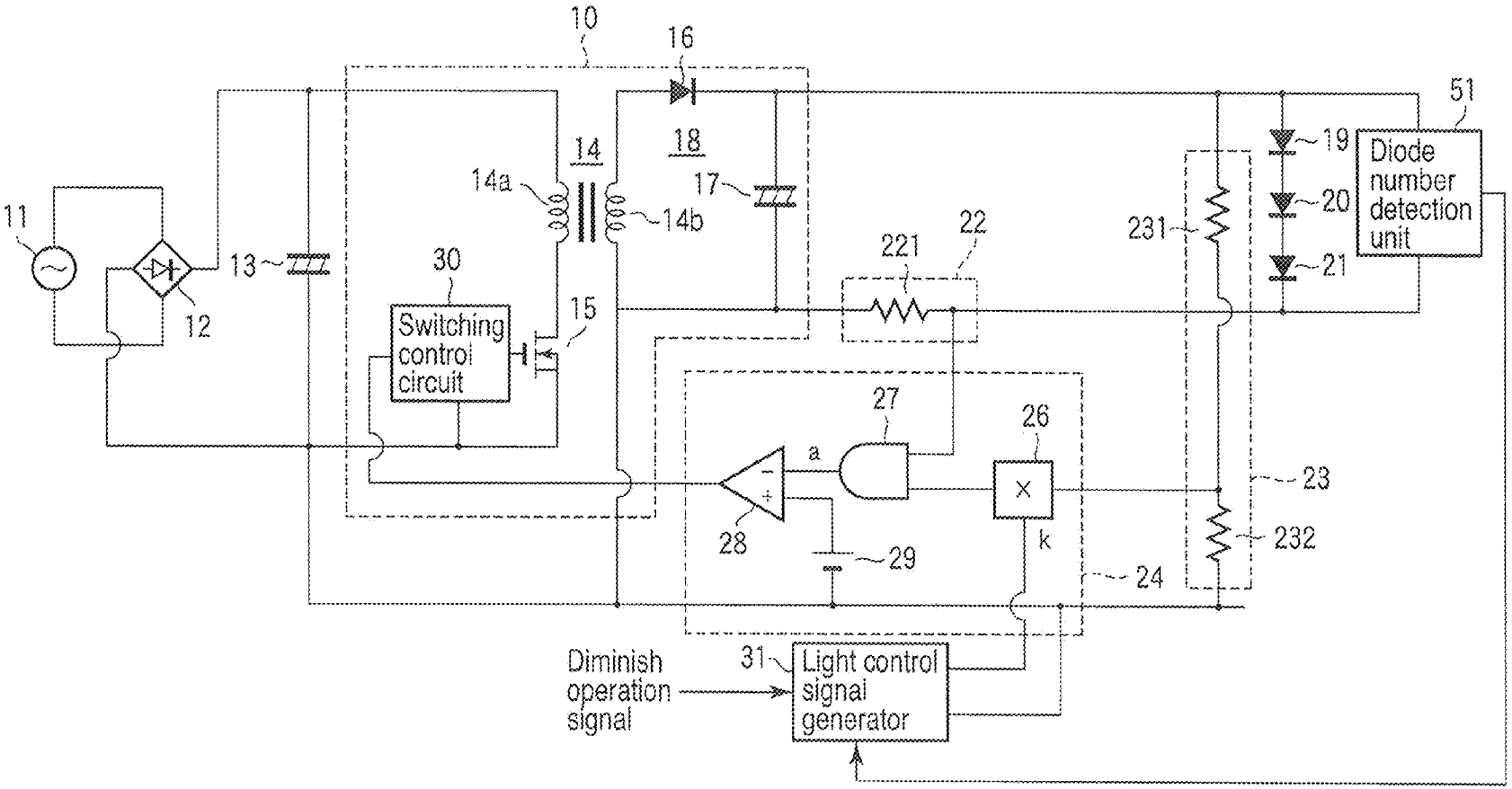
FIG. 11 is a circuit diagram schematically illustrating the circuit configuration of the power supply unit according to a third embodiment of the present invention.

In this power supply unit, as shown in FIG. 11, a number detecting part 51, for example, is connected to the light-emitting diodes 19 to 21, and a detected signal from the number detecting part 51 is input into the dimmer signal generator 31. The dimmer signal generator 31 changes over to the load characteristics according to the dimmer rates k1 to k7 so as to output the dimmer signal k to the multiplier 26. The dimmer signal generator 31 selects the load characteristic corrected according to the dimmer rates k1 to k7 in response to the light-emitting diodes 19 to 21 detected by the number detecting part 51, namely, the detected signal from the number detecting signal 51, and outputs the dimmer signal k to the multiplier 26 according to the corrected load characteristic.

Figure 12:
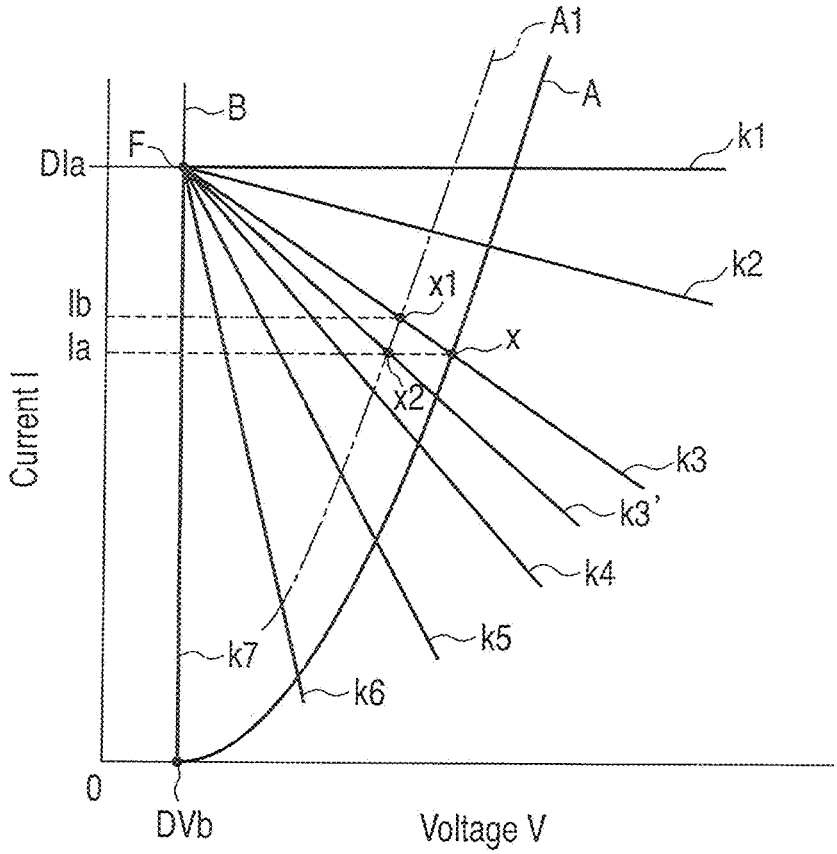
FIG. 12 is a graph describing an operation of the power supply unit shown in FIG. 11.

More concretely, in the state that all the light-emitting diodes 19 to 21 are connected, as shown in FIG. 12, an operation point which intersects with the V-I characteristic A of the light-emitting diodes and the load characteristic corresponding to the dimmer rate k3 is at the point x. In this state, when the number of the connected light-emitting diodes is changed and only the light-emitting diodes 19 and 20 are connected, the V-I characteristic of the light-emitting diodes is changed into A1. Therefore, an operation point which intersects with the load characteristic corresponding to the dimmer rate k3 is moved to x1, and the electric current flowing in the light-emitting diodes is changed from Ia into Ib. In the third embodiment, however, when the detected signal from the number detecting part 43 for detecting the connected state of the light-emitting diodes 19 and 20 is given to the dimmer signal generator 31, the dimmer signal generator 31 corrects the selected dimmer rate k3 to the dimmer rate k3' and changes over the load characteristic into a load characteristic corresponding to the dimmer rate k3' according to the detected signal. As a result, the operation point which intersects with the V-I characteristic A1 of the light-emitting diodes is moved from the point x1 to the point x2, so that the electric current flowing in the light-emitting diodes is also corrected to Ia.

(Fourth Embodiment)

As described above, the load characteristics corresponding to the dimmer rates k1, k2, . . . k7 can be expressed by a liner function of V=DVb−k(I). A relationship: V+k(I)DVb(2) holds, and the load, namely, a value, which is obtained by adding an operated result of the dimmer signal voltage to the load voltage detected value and the current detected value in the light-emitting diodes, becomes a constant voltage value DVb.

Figure 13:
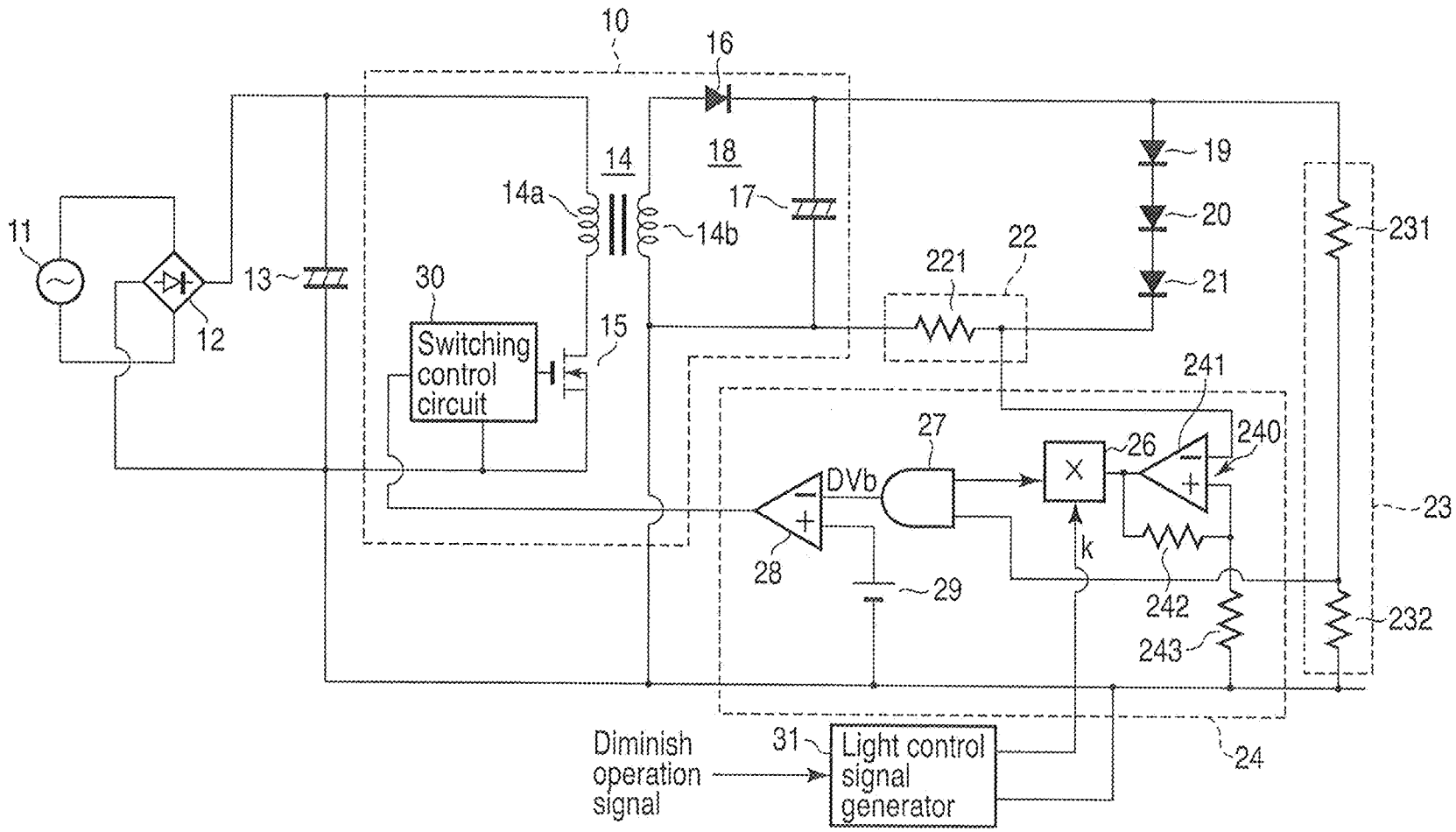
FIG. 13 is a circuit diagram schematically illustrating a circuit configuration of the power supply unit according to a fourth embodiment of the present invention.

The relationship in which the value, which is obtained by adding the operated result of the dimmer signal voltage to the load voltage detected value and the current detected value in the light-emitting diodes becomes the constant voltage value DVb can be realized by a circuit shown in FIG. 13.

FIG. 13 illustrates a schematic constitution of the power supply unit according to a fourth embodiment of the present invention, and the same parts as those in FIG. 5 are denoted by the same symbols. In the circuit shown in FIG. 13, an amplifying circuit 240 is connected to a connection point between the series circuit of the light-emitting diodes 19 to 21 and the resistor 221. The amplifying circuit 240 is composed of a differential amplifier 241 and resistors 242 and 243 in order to detect the electric current flowing in the light-emitting diodes 19 to 21, and convert the detected current into a voltage signal. An output side of the amplifying circuit 240 is connected to the multiplier 26. Therefore, the amplifying circuit 240 converts the detected current into the voltage signal, and the multiplier 26 multiplies the converted signal by the dimmer signal k. The adder 27 adds the multiplied signal k (I) to the detected voltage signal V related to the voltage applied to the light-emitting diodes 19 to 21, and the comparator 28 compares the added signal (V+k(I)) with the constant reference voltage value 29. The compared result from the comparator 28 is output as a control signal to the dimmer signal generator 31.

Also in the circuit shown in FIG. 13, similarly to the circuit shown in FIG. 5, the constant voltage control and/or the constant current control are/is made according to the dimmer rate k, and the electric current flowing in the light-emitting diodes 19 to 21 and the voltage applied to the light-emitting diodes 19 to 21 are controlled according to the dimmer signal k.

Therefore, also in the power supply unit according to the fourth embodiment, the similar effect to that of the first embodiment can be obtained, and even if the V-I characteristic changes due to the change in the number and type of connected light-emitting diodes, the electric current flowing in the light-emitting diodes can be corrected into a constant state, so that the constant light output can be always obtained.

The present invention is not limited to the above embodiment, and at the stage of practicing the present invention, the present invention can be modified variously within a range where the gist is not changed. The above embodiments describe the example of the analog circuit, but control systems using a microcomputer and a digital process can be adopted. Further, the changing-over of the dimmer rate includes continuous dimmer and gradual dimmer, and phase control in which a conducting period of a power supply voltage is controlled and an effective voltage to the load is varied may be adopted. A dedicated signal line is used for the dimmer signal, or a power-line signal which is obtained by superimposing a dimmer signal on a power supply electric wire can be used.

In the embodiments described above, the power supply unit which lights the light emitting diodes 19 to 21 is comprised of the AC power supply 11, the full-wave rectifying circuit 12, the smoothening capacitor 13, the DC-DC converter 10, and the rectifying smoothening circuit 18, and the signal control section 24 is independent from the power supply unit. However, the signal control section 24 may be incorporated in the power supply unit, or a part of the the power supply unit and the signal control section 24 may be formed in a single circuit module.

The above embodiments describe the power supply unit and the lighting unit for lighting the semiconductor light emitting modules such as the light-emitting diodes. In the embodiments, a category of the semiconductor light emitting modules may include EL light source devices such as an organic EL light source and an inorganic EL light source. Thus, the technical concept of the invention can be applied to the power supply unit and the lighting unit for the EL light source devices such as an organic EL light source and an inorganic EL light source.

In addition, in the power supply unit shown in FIGS. 9 and 11, the detector 43, 51 detects the number of the light emitting diodes. In a power supply unit for the EL light source devices such as the organic EL light source and the inorganic EL light source in which the light emitting modules 19 to 21 are substituted by the EL light source, the detector 43, 51 may detect a voltage applied to the organic EL light source and the inorganic EL light source in stead of the number of the light emitting diodes and the signal control section 24 may control a load characteristic of the organic EL light source or the inorganic EL light source depending on the detected voltage signal from the detector 43, 51. In the brightness control of the organic EL light source or the inorganic EL light source, since, there is no concept of the number for the EL light source, thus, there is no detector of detecting the number of the EL light sources.

According to the present invention, the power supply unit and the lighting unit which can realize stable dimmer control can be provided.

According to the embodiments of the present invention, there can be provided the power supply unit and the lighting unit, which select the load characteristic having the tendency of the constant current characteristic or the load characteristic having the tendency of the constant voltage characteristic according to the dimmer rate so as to realize the dimmer control. In the power supply unit and the lighting unit, smooth transition between the control having the strong tendency for the constant current characteristic and the control having the strong tendency for the constant voltage control characteristic can be realized according to the dimmer rate.

There can be provided the power supply unit and the lighting unit, which change over the dimmer control system smoothly from the constant current characteristic into the constant voltage characteristic or from the constant voltage characteristic into the constant current characteristic only by means of the change in the dimmer rate so as to enable the stable dimmer control over a wide rage covering from the small dimmer rate area to the large dimmer rate area.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A power supply unit, comprising:

a semiconductor light emitting module:

a power supply part configured to light the semiconductor light emitting module in accordance with a load characteristic including a plurality of inclination lines extending from a base point, the plurality of inclination lines having inclinations depending on dimmer rates, respectively;

a voltage detecting part configured to detect a load voltage applied to the semiconductor light emitting module to generate a voltage detection signal;

a current detecting part configured to detect an electric current supplied to the semiconductor light emitting module to generate a current detection signal; and a control part configured to control the power supply part depending on the voltage detection signal, the current detection signal, and a dimmer signal corresponding to one of the dimmer rates, to adjust a power supplied to the semiconductor light emitting module from the power supply part and set the power depending on the load characteristic and the one of the plurality of inclination lines which is set in accordance with the dimmer rate corresponding to the dimmer signal; the control part being configured to control the power supply part depending on a constant current characteristic, a constant voltage characteristic, and/or a combination of a constant current characteristic and a constant voltage characteristic, such that if the dimmer rate is smaller than a predetermined rate, then the current detection signal is weighted and the control part controls the power supply part depending on the constant current characteristic or a combination of the constant current characteristic and the constant voltage biased towards the constant current characteristic, and if the dimmer rate is not smaller than the predetermined rate, then the voltage detection signal is weighted and the control part controls the power supply part depending on the constant voltage characteristic or a combination of the constant voltage characteristic and the constant current characteristic biased towards the constant voltage characteristic.

2. The power supply unit according to claim 1, wherein:

each of the plurality of inclination lines is radially extended from a base point DIa depending on the one of the plurality of dimmer rates; and each of the inclination lines of the load characteristic is substantially expressed by a function formula of {I+k (V)=Dia}, where I represents the electric current flowing in the semiconductor light emitting module, V represents the load voltage applied to the semiconductor light emitting module, and k represents one of the dimmer rates.

3. A lighting unit comprising:

the power supply unit according claim 2; and a unit main body comprising the power supply unit.

4. A lighting unit comprising:

the power supply unit according claim 1; and a unit main body comprising the power supply unit.

* * * * *